US006290469B1

(12) United States Patent
Archibald

(10) Patent No.: US 6,290,469 B1
(45) **Date of Patent: *Sep. 18, 2001**

(54) HAND HELD, SELF-POWERED PUMP

(76) Inventor: Frank E. Archibald, 51 Judds Bridge Rd., Roxbury, CT (US) 06783

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/855,452

(22) Filed: May 13, 1997

(51) Int. Cl.[7] ..... F04B 53/00

(52) U.S. Cl. ..... 417/234; 417/411; 417/423.14; 417/424.2

(58) Field of Search ..... 417/411, 423.14, 417/424.2, 234; 415/213.1, 201, 118, 212.1, 203; 416/63

(56) References Cited

U.S. PATENT DOCUMENTS

| | | | | |
|---|---|---|---|---|
| 2,595,406 | * | 5/1952 | Popovich | 230/259 |
| 2,736,606 | * | 2/1956 | Kmiotek | 299/89 |
| 2,806,432 | | 9/1957 | Brooks . | |
| 3,469,528 | * | 9/1969 | East | 103/25 |
| 3,910,725 | * | 10/1975 | Rule | 417/234 |
| 4,101,950 | | 7/1978 | Hager et al. . | |
| 4,705,464 | * | 11/1987 | Arimond | 417/477 |
| 5,002,154 | | 3/1991 | Chen . | |
| 5,163,818 | * | 11/1992 | Betsill et al. | 417/18 |
| 5,367,740 | | 11/1994 | McCray . | |
| 5,472,317 | * | 12/1995 | Field et al. | 417/234 |
| 5,634,791 | * | 6/1997 | Matsuura et al. | 433/87 |

* cited by examiner

*Primary Examiner*—Timothy S. Thorpe
*Assistant Examiner*—Ehud Gartenberg
(74) *Attorney, Agent, or Firm*—Siemens Patent Services, LC

(57) ABSTRACT

A portable, self-contained pump having a battery carried on board. The pump includes a pumping device for forcing liquids to flow, such as those including impellers, plungers or reciprocating pistons, diaphragms, and others, a motor, the battery, electrical circuitry connecting the battery to the motor, and a housing enclosing the aforementioned components. A clip for suspending the pump from the belt of a user is fixed to the housing. The housing also includes an access panel affording access to the interior of the pumping device for service, such as clearing clogs, and a switch for controlling the motor. A threaded inlet nipple and a threaded outlet nipple project from the housing. Accessories for the pump include a stand, a plurality of auxiliary hoses or conduits enabling retrieval and directing discharge of liquids, and an auxiliary liquid receptacle for dispensing liquids from the novel pump. The auxiliary conduits are threaded for enabling connection to the inlet and outlet nipples.

5 Claims, 3 Drawing Sheets

HAND HELD, SELF-POWERED PUMP

BACKGROUND OF THE INVENTION

1. Field of the Invention

The present invention relates to a hand held pump. More particularly, the invention comprises a pump having an independent source of operating power carried aboard the pump. The novel pump is therefore both portable and independent of connection to external power, and may be operated while carried by a person.

2. Description of the Prior Art

Certain household tasks entail transfer of relatively small quantities of water into or out of vessels. For example, to undertake repair and modification to major water utilizing appliances and related plumbing, it may be necessary or advantageous to remove water prior to performing the repair or modification. In some cases, water, particularly wastewater, will foul environmental surfaces. Removal of inoperative appliances and disconnection of appliances such as sinks, toilets, dishwashers, and garbage grinders is facilitated to a certain extent if standing wastewater is removed.

It may be objectionable or in some cases not feasible to remove this water by hand. The water may be filthy or contaminated, or may be nearly inaccessible for purposes of inserting a cup or other object for bailing out water. In some cases, it may be desirable to add water to a vessel rather than to remove it. For example, a suspended plant container disposed near the ceiling of a room may prove difficult to water in the absence of pressure acting on the water. There exists a need, therefore, for a pump suitable for carrying by hand and which is adapted to perform transfer of small quantities of water.

The prior art has suggested small portable pumps. An example is seen in U.S. Pat. No. 2,806,432, issued to Jerry R. Brooks on Sep. 17, 1957. The subject of this patent comprises a pump having an attached tether for suspending the pump during operation. Power is obtained by connection to a convenient battery, which is not part of the invention. By contrast, the present invention has a clip for mounting on the belt of the user, and incorporates an integral battery, so that the novel pump is independent of external power.

Other portable pumps are seen in U.S. Pat. No. 4,101,950, issued to Donald L. Hager et al. on Jul. 18, 1978, U.S. Pat. No. 5,002,154, issued to Kuo-Neng Chen on Mar. 26, 1991, and U.S. Pat. No. 5,367,740, issued to Kimothy R. McCray on Nov. 29, 1994. The pumps of this group all lack integral apparatus for suspending the pump from an environmental object, and all derive power from a power cord and plug assembly. By contrast, the present invention has a clip for belt mounting, and incorporates an integral battery for power.

None of the above inventions and patents, taken either singly or in combination, is seen to describe the instant invention as claimed.

SUMMARY OF THE INVENTION

The present invention provides a portable pump which is adapted for mounting to the belt of a user, and which has an integral battery carried aboard, so that the pump is independent of connection to external power. The battery is rechargeable, and thus can be recharged when the pump is not in use.

The pump has a slightly elongated body, with inlet and outlet nipples protruding from the upper portion of the body. An on-off switch and an access panel to the pump impeller are also disposed upon the body.

The pump is provided with a separate floor stand, so that the pump need not be either hand held or suspended from a user's belt during use. Optionally, the pump may be provided commercially as a kit including several auxiliary conduits which thread selectively to the inlet and outlet nipples. These conduits may be semi-rigid, or rigid and preformed. A preferable formed rigid conduit is J-shaped. This conduit, when connected to the pump, is capable of delivering water to domestic plants suspended from and located close to a ceiling, or in another location suffering from limited access. An auxiliary water tank having holes for insertion of an auxiliary conduit for retrieving water may be employed with a second auxiliary conduit for dispensing water.

Semi-rigid conduits are bendable by hand, but will maintain a configuration once bent, or until subjected to forces equivalent to those required for bending. Additionally, a flexible auxiliary conduit is provided. Flexible and semi-rigid conduits are capable of being inserted into remote or poorly accessed locations for retrieval of water.

Accordingly, it is a principal object of the invention to provide an electrically operated pump which is independent of connection to external power.

It is another object of the invention to provide a clip for mounting the novel pump to a belt worn by a user.

It is a further object of the invention to enable threaded connection of conduits to the novel pump. Still another object of the invention is to provide a manual control on the pump.

An additional object of the invention is to provide auxiliary conduits for retrieving and dispensing liquids, which auxiliary conduits are threadably engageable with the novel pump.

It is again an object of the invention to provide an auxiliary liquid storage tank for storing liquids for dispensing, which auxiliary tank is compatible with auxiliary conduits.

Another object is to size and shape the external housing of the pump to facilitate easy gripping and carrying in a single hand of a user.

Yet another object of the invention is to enable inspection of and access to the impeller of the pump.

A still further object of the invention is to provide a detachable stand for supporting the pump on a horizontal surface.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
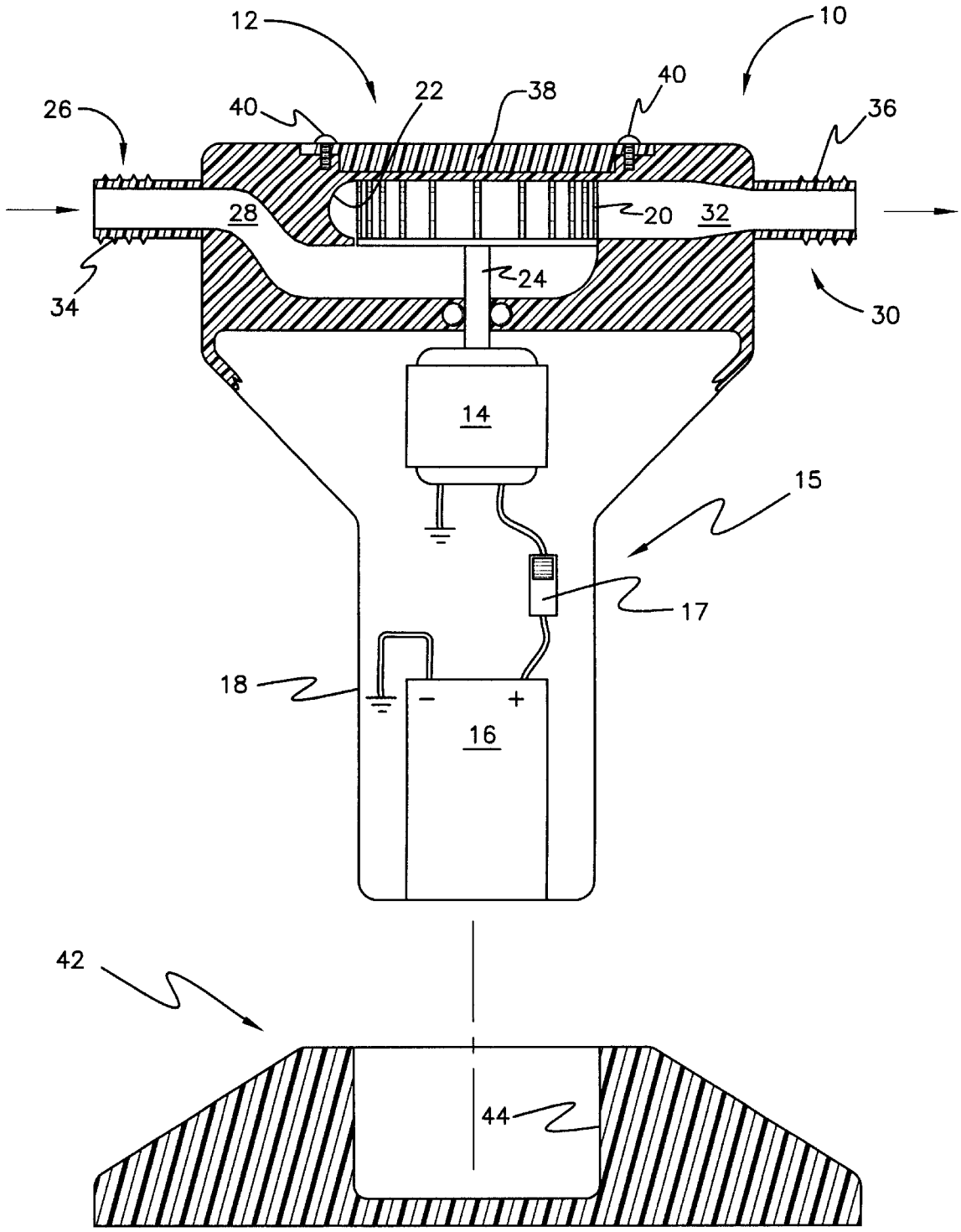
FIG. 1 is a front elevational, partly cross sectional, diagrammatic view of the novel pump, shown elevated above an optional stand.

Turning now to FIG. 1 of the drawings, the novel portable, self-contained pump 10 comprises any suitable pumping device 12 for inducing water to flow, an electric motor 14 for operating pumping device 12, a battery 16 for powering motor 14 independently of connection to external power, electrical circuitry 15 connecting battery 16 to motor 14, and a housing 18 for enclosing and containing pumping device 12, motor 14, and battery 16. Circuitry 15 includes a switch 17 for controlling electrical current flowing from battery 16 to motor 14.

In the embodiment of FIG. 1, pumping device 12 is of the type having a rotatable impeller 20 surrounded by a voluted housing 22, impeller 20 being connected to motor 14 by a shaft 24. This rotatable impeller 20 is also known as a "squirrel cage" type. The liquid is actually impelled out of the pump 10 by centrifugal force. With this type of rotatable centrifugal impeller, only low water pressure at outlet 30 is generated, which is adequate for the contemplated uses of the present invention. Note that in the embodiment shown, since the shaft is centrally located along the general longitudinal axis of the device, the pump 10 would be virtually vibration-free when operating. Also, note that with this rotatable centrifugal type impeller, a substantial seal must be maintained between suction side 28 and outlet or discharge side 32. This is accomplished by having the bottom of the rotatable impeller 20 fit snugly between these two areas 28, 32 as indicated at 100 and 102 in FIG. 1. Additionally, a seal should be maintained around the shaft 24, as indicated at 104 (also indicated in FIG. 1), since shaft 24 extends upwards through the suction or intake side 28. Of course, pumping device 12 may alternatively comprise a diaphragm pump, rotary gear pump, peristaltic pump, progressive cavity pump, plunger pump, or any other suitable device (none shown) for forcing liquids to flow. Motor 14 will be understood to be of a type appropriate for the selected pumping device, and will include necessary motion translation and transmission components.

Liquids (not shown) enter pump 10 through an inlet nipple 26 communicating with the suction side 28 of pumping device 12 and an outlet nipple 30 communicating with the discharge side 32 of pumping device 12, for connection of conduits (see FIG. 3) to pump 10. Nipples 26 and 30 each bear male threads 34, 36 (respectively) for accommodating threaded connection of conduits to pump 10.

From time to time, it will become necessary to reveal the interior of pumping device 12 for inspection and service. Pumps employed to evacuate wastewater occasionally become clogged by debris (not shown) entrained within the water. Opening the interior of pumping device 12 will expose impeller 20 for removal if required to dislodge debris. To this end, pump 10 includes an access panel 38 secured to housing 18 by screws 40. Panel 38 normally covers the interior of pumping device 12, and is removed as required to reveal impeller 20 without requiring removal of either motor 14 or shaft 24.

The lower portion of housing 18 is formed so as to be easily gripped and carried by a single hand of a user. To this end, suitable gripping projections, etc. (not shown) may be formed on the lower portion of housing 18.

When not being held by hand or suspended from the user's belt, pump 10 may be supported by a stand 42. Stand 42 has a receptacle 44 dimensioned and configured to receive pump 10, and supports pump 10 on any horizontal environmental surface (not shown) in an erect posture corresponding to the orientation shown in FIG. 1. It is preferable that battery 16 be of the rechargeable type, although this is not necessary. If battery 16 is rechargeable, then stand 42 may be modified to include electrodes, a power converter, and an electrical supply cord (none shown) for enabling battery 16 to be recharged when pump 10 is not in use.

Figure 2:
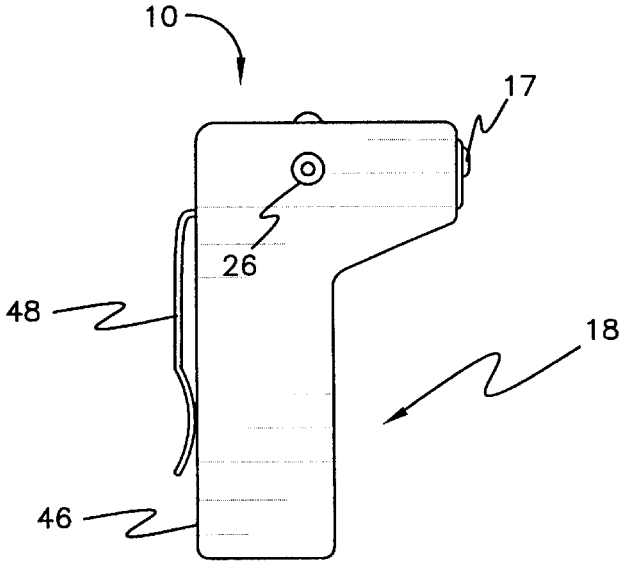
FIG. 2 is a side elevational view of the novel pump.

Referring now to FIG. 2, housing 18 has a flat or planar lateral exterior surface 46 to which a clip 48 is affixed. Clip 48 is of any suitable type for slipping over or engaging the belt of a user, so that pump 10 may be suspended from the belt, thereby freeing the user's hands from supporting pump 10. FIG. 2 also illustrates an advantageous location on the exterior of housing 18 for switch 17.

Figure 3:
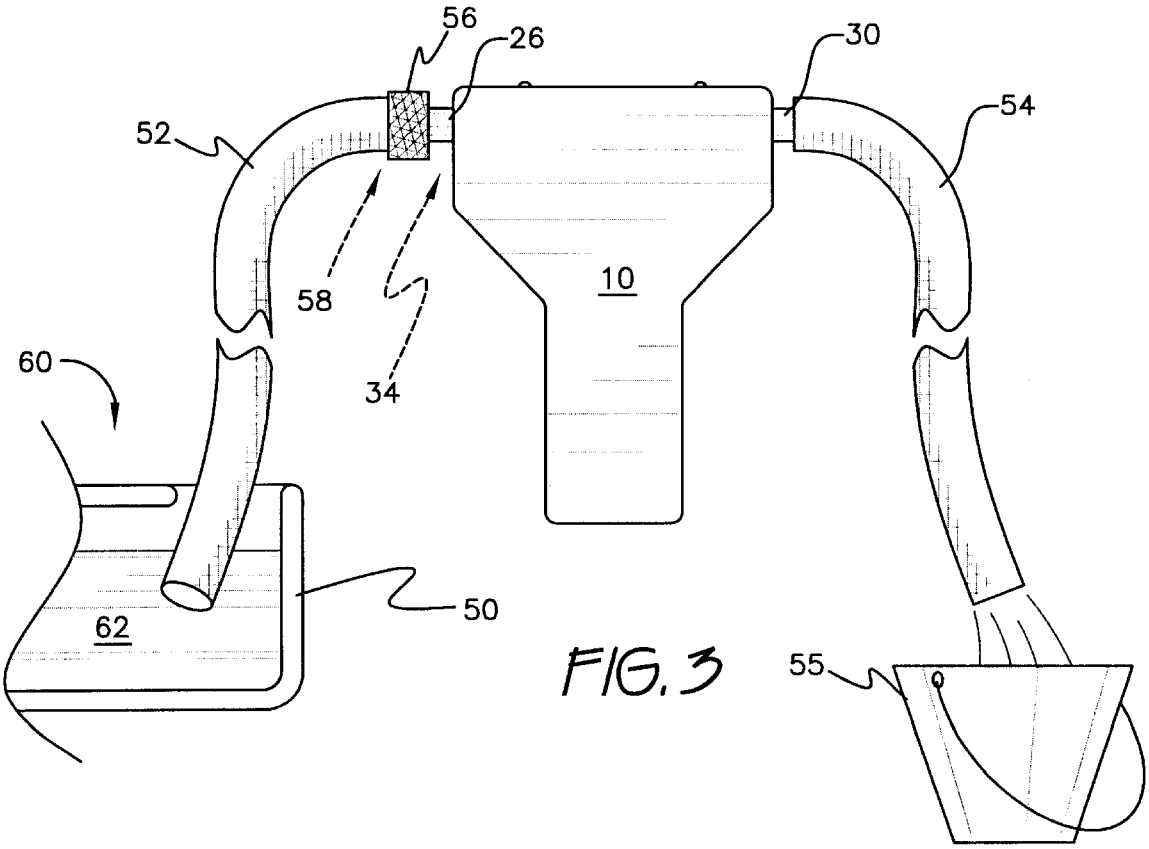
FIGS. 3 and 4 are environmental, diagrammatic, front elevational views of the invention, illustrating liquid retrieval and liquid dispensing, respectively.

FIG. 3 illustrates retrieval of liquid from an environmental object 50. Auxiliary conduits 52 and, optionally, 54, are connected to pump 10. Provision of conduit 52 enables retrieving liquids from locations inaccessible for direct communication with pump 10. Auxiliary conduit 54 is employed when it is desired to direct liquids being discharged from pump 10 in a particular direction, such as into a collection vessel 55.

Conduit 52 is semi-rigid, this property being conferred by virtue of construction including a spirally wound metallic strip forming the wall of conduit 52. Conduit 54 includes a terminal 56 having female threads 58 which are compatible with male threads 34 of nipple 26. Conduit 52 is inserted into an opening 60 formed in object 50 and the free end of conduit 52 is submerged within liquid 62 being evacuated from object 50.

As shown in FIG. 3, conduit 54 has been connected to nipple 30. Conduit 54 is flexible, and may be provided with a threaded terminal (not shown) similar to that of conduit 54, or may alternatively engage nipple 30 by friction, resilient constriction, or by a clamp (not shown).

Figure 4:
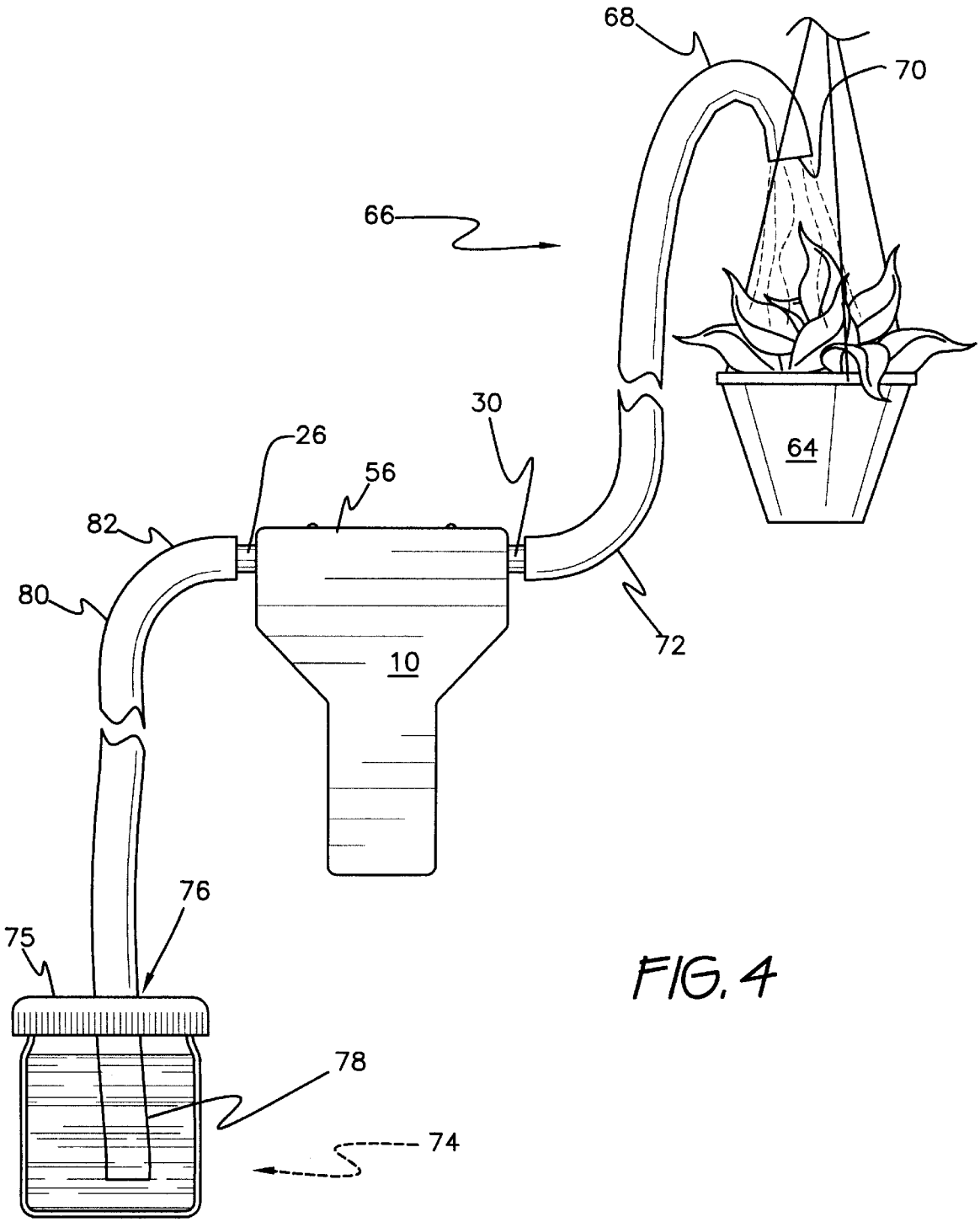

FIG. 4 illustrates dispensing of liquids to a desired location. In this example, water is being dispensed for watering a pot 64 suspended at a height which is inaccessible or inconvenient for watering by pouring from a watering can (not shown) or the like. Pump 10 is utilized to force water, and accurate delivery is assured by utilizing a rigid auxiliary conduit 66.

Conduit 66 is preformed to include a bend at 68 providing advantageous orientation of the open end 70 of conduit 66. Conduit 66 engages nipple in any suitable way. A second bend at 72 may be provided for enabling conduit 66 to project vertically from pump 10 when connected.

A separate liquid receptacle 74 is provided for storing a supply of water for watering. Receptacle 74 has a threaded cap 75 having at least one access hole 76 formed therein for receiving an end 78 of an auxiliary conduit 80. End 78 of conduit 80 is submerged below the level of liquid stored in receptacle 74. Conduit 80 is connected to nipple 26 at its other end 82. Conduit 80 may be semi-rigid or flexible, as desired.

The present invention is susceptible to variations and modifications which may be introduced by those of skill in the art without departing from the inventive spirit. For example, threading of nipples 26, 30 may be omitted if desired. In a further alternative, one or both nipples 26, 30 may be omitted in favor of threaded ports (not shown).

The various auxiliary conduits 52, 54, 66, 80 may be of lengths, diameters, and constituent materials as desired.

Semi-rigid conduit 52 may be fabricated in ways other than by spiral wound metallic strip, this construction being merely exemplary.

It is to be understood that the present invention is not limited to the embodiments described above, but encompasses any and all embodiments within the scope of the following claims.

I claim:

1. A portable pump, comprising: a housing, a battery, an electric motor, and a pumping element; said housing comprising first, second, and a third components; said first component and third component each having at least one long side and two ends; said second component being frusto-conical and having a smaller end connected to one end of the first component and one larger end connected to the at least one side of the third component; the longitudinal axis of the second component being in direct continuation of the longitudinal axis of the first component and perpendicular to the longitudinal axis of the third component; the first component housing said battery and an electrical switch; the second component housing said motor; the third component housing said pumping element and having an inlet at one end, an outlet at the other end and a removable access panel to the pumping element.

2. The portable pump as recited in claim 1, further comprising a stand adapted to receive a portion of said housing and for maintaining said housing in a predetermined, substantially upright position during both operation and storage of said pump.

3. The portable pump as recited in claim 2, wherein said battery comprises a rechargeable battery and said stand comprises a battery charger having electrical contacts adapted to convey an electrical current from said battery charger to said rechargeable battery.

4. The portable pump as recited in claim 1, wherein at least one of said inlet and said outlet is threaded and adapted for connecting an external conduit thereto.

5. The portable pump as recited in claim 4, wherein at least one of said threaded inlet and said threaded outlet comprises a nipple having external threads.

* * * * *